United States Patent [19]

Tanaka

[11] Patent Number: 4,646,400

[45] Date of Patent: Mar. 3, 1987

[54] BUCKLE APPARATUS

[75] Inventor: Kohbun Tanaka, Aichi, Japan

[73] Assignee: Kabushiki Kaisha Tokai-rika-denki-seisakusho, Aichi, Japan

[21] Appl. No.: 758,678

[22] Filed: Jul. 25, 1985

[30] Foreign Application Priority Data

Jul. 30, 1984 [JP] Japan ..... 59-160085

[51] Int. Cl.[4] ..... A44B 11/26

[52] U.S. Cl. ..... 24/632; 24/637; 24/650

[58] Field of Search ..... 24/632, 633, 634, 643, 24/648, 649, 650, 574, 637

[56] References Cited

U.S. PATENT DOCUMENTS

| | | | |
|---|---|---|---|
| 3,473,201 | 10/1969 | Hopka et al. | 24/632 |
| 3,605,207 | 9/1971 | Glauser et al. | 24/632 |
| 3,825,979 | 7/1974 | Jakob | 24/574 |
| 3,921,262 | 11/1975 | Tanaka | 24/637 |
| 3,932,917 | 1/1976 | Dobelmann | 24/650 |
| 4,060,879 | 12/1977 | Takada | 24/637 |
| 4,128,924 | 12/1978 | Happel et al. | 24/632 |
| 4,196,500 | 4/1980 | Happel et al. | 24/632 |
| 4,377,888 | 3/1983 | Ikesue | 24/637 |
| 4,404,715 | 9/1983 | Sugimoto | 24/633 |

*Primary Examiner*—Victor N. Sakran

*Attorney, Agent, or Firm*—Sixbey, Friedman & Leedom

[57] ABSTRACT

A buckle apparatus employed in a seatbelt system for a vehicle is engaged with a tongue plate attached to one end portion of an occupant restraining webbing. The apparatus includes a pair of plate-like buckle bodies which are disposed substantially parallel to each other so that it is possible for a plurality of tongue plates to be inserted into the space defined between the pair of buckle bodies. The tongue plates are engageable with respective lock plates mounted on the buckle bodies. An engagement projection which projects from one of the buckle bodies is received in an engagement recess formed in the other buckle body, whereby the movement of the relative positions of the buckle bodies is limited. The plurality of lock plates are simultaneously disengaged from the respective tongue plates by actuating a single pushbutton, thereby allowing the tongue plates to be pulled out of the buckle bodies.

13 Claims, 12 Drawing Figures

BUCKLE APPARATUS

BACKGROUND OF THE INVENTION

1. Field of the Invention

The present invention relates to a buckle apparatus for use in a seatbelt system designed to protect an occupant of a vehicle when an emergency situation occurs, the buckle apparatus being used when the occupant fastens an occupant restraining webbing around his body.

2. Description of the Prior Art

A seatbelt system of the above-described type is arranged such that an occupant engages a tongue plate, which is provided at one end of a webbing, with a buckle apparatus, thereby fastening the webbing around his body.

Such buckle apparatus generally includes a buckle body which is formed by bending a metallic plate material into a U-like shape. The tongue plate is inserted into the buckle body, and a lock plate which is disposed within the buckle body is engaged with the tongue plate, thereby preventing the tongue plate from being pulled out of the buckle body.

Accordingly, it is necessary for the buckle apparatus of this structure to employ a buckle body with a relatively large wall thickness, which fact disadvantageously involves an increase in the weight of the buckle apparatus. Further, the structure of this type of buckle apparatus allows only a single tongue plate to be engaged therewith. It is therefore inconveniently difficult for such a structure to be applied to a buckle apparatus which is required to have two tongue plates engaged therewith at the same time, such as that which is employed in a four-point webbing fastening type seatbelt system, a seatbelt system for restraining a child passenger, etc.

SUMMARY OF THE INVENTION

In view of the above-described circumstances, it is a primary object of the present invention to provide a buckle apparatus which is light in weight and small in size as well as being capable of coping with the need to insert a plurality of tongue plates into it.

To this end, the invention provides a buckle apparatus which has a pair of buckle bodies disposed such as to oppose each other and adapted to receive a tongue plate therebetween. These buckle bodies are provided with retainer means disposed at at least three positions thereon. One of the retainer means is constituted by an engagement projection formed on one of the buckle bodies and an engagement recess formed in the other. The engagement projection is received in the engagement recess, thereby limiting the dimension of the space between the buckle bodies.

By virtue of the above-described arrangement, the dimension of the space between the pair of buckle bodies is limited by the retainer means, which fact advantageously provides the buckle apparatus with a favorably large resistance against any force acting on the tongue plate in a direction which would lead to it being undesirably pulled out of the buckle apparatus. It is therefore possible for the buckle apparatus to be reduced in both size and weight as a whole. If a plurality of lock plates are mounted on the buckle bodies, it is possible for the buckle apparatus to cope with the need for a plurality of tongue plates to be engaged therewith when inserted into the space defined between the buckle bodies in directions which are different for each tongue plate.

BRIEF DESCRIPTION OF THE DRAWINGS

The above and other objects, features and advantages of the present invention will become more apparent from the following description of the preferred embodiment thereof, taken in conjunction with the accompanying drawings, in which like reference numerals denote like elements, and in which.

DESCRIPTION OF THE PREFERRED EMBODIMENT

Figure 1:
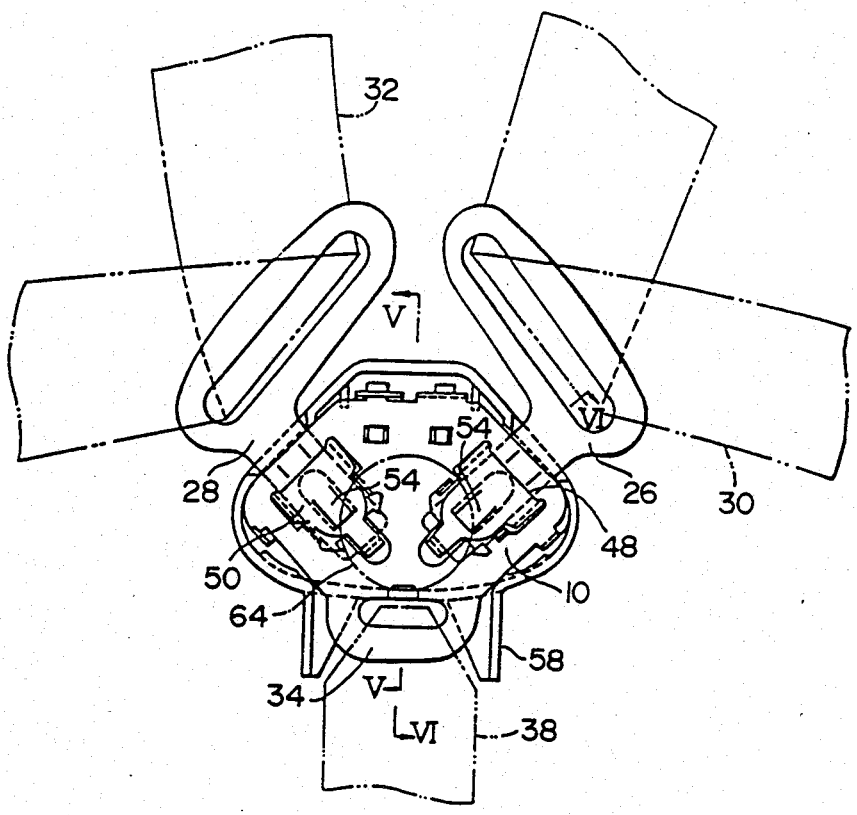
FIG. 1 is a plan view of one embodiment of the buckle apparatus according to the present invention, with an upper cover thereof removed.
Figure 2:
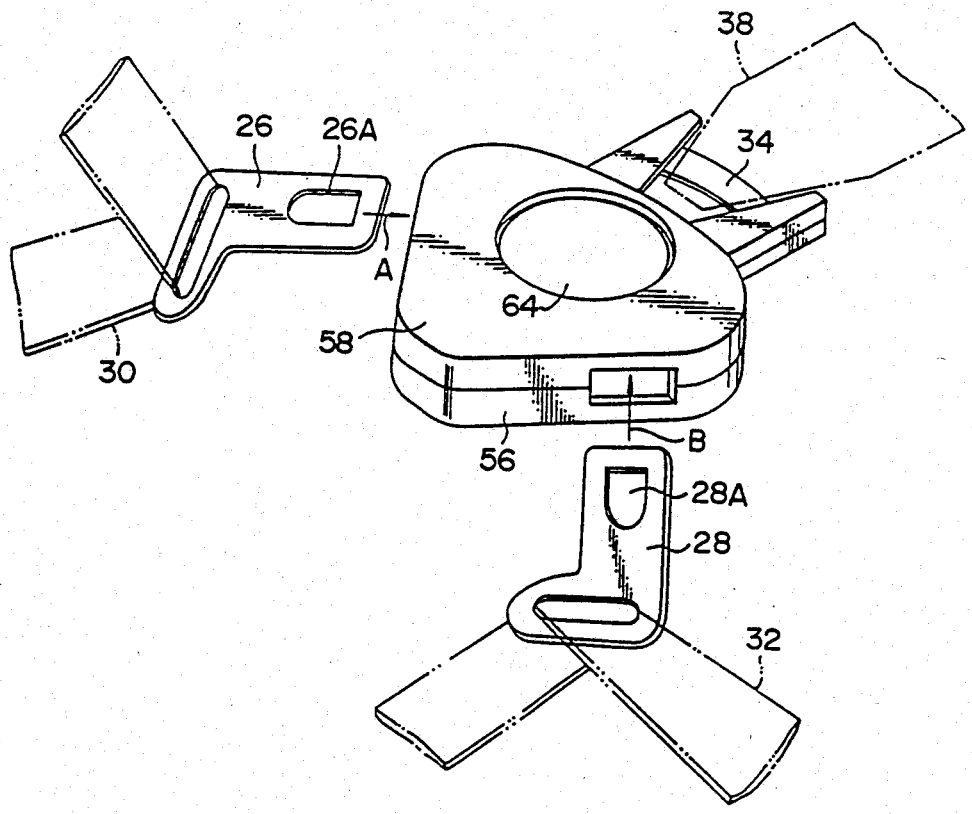
FIG. 2 is a perspective view of the embodiment in a state wherein tongue plates are pulled out of the buckle apparatus.
Figure 3:
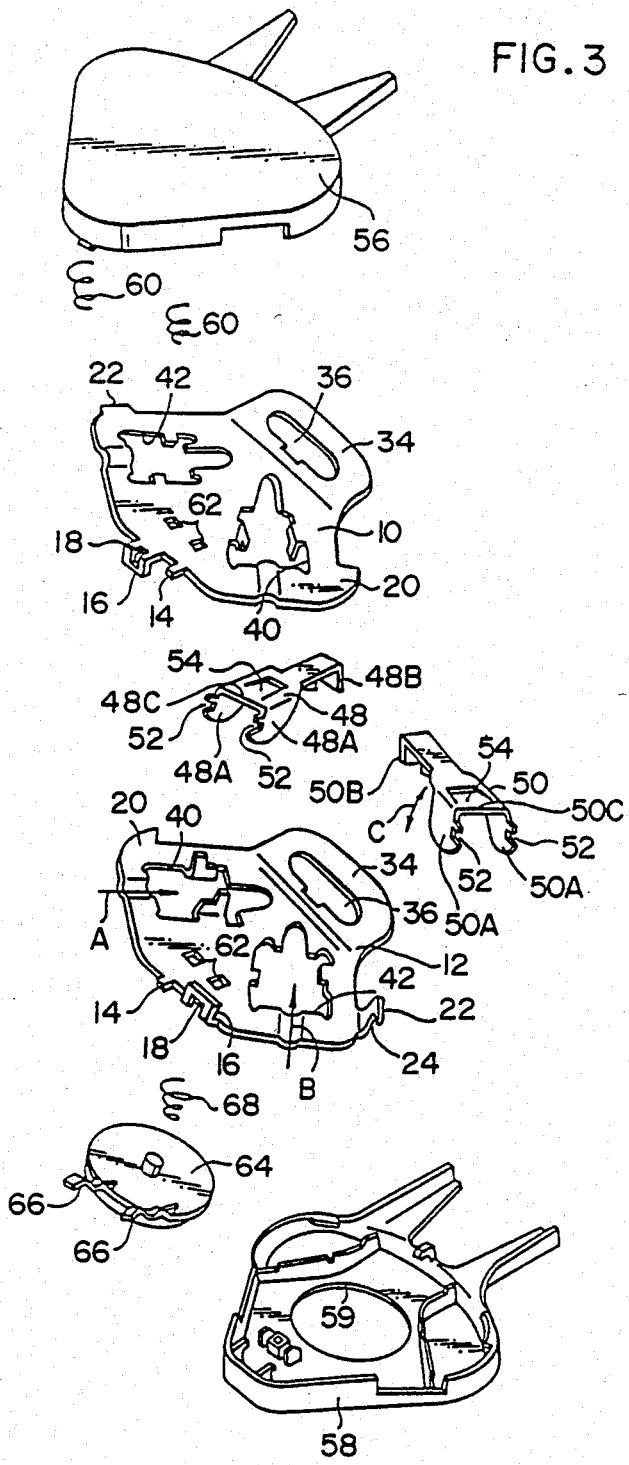
FIG. 3 is an exploded perspective view of the embodiment.
Figure 4:
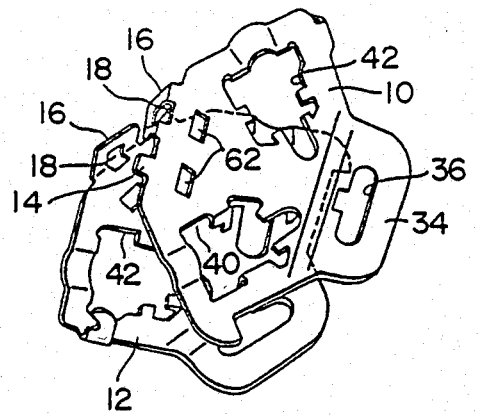
FIG. 4 is a perspective view of a pair of buckle bodies employed in the embodiment, which shows the way in which they are assembled together.

Referring first to FIGS. 1 to 3, there is shown one embodiment of the present invention in which it is applied to a seatbelt system for restraining a child passenger. In a buckle apparatus in accordance with this embodiment, a pair of buckle bodies 10 and 12 are formed from a thin-walled plate material. These buckle bodies 10 and 12 have the same configuration as each other and are assembled together in a state wherein one of them is turned upside down.

Each of the buckle bodies 10 and 12 is formed at one end portion thereof with an enagement projection 14 and a bent piece 16 which is adjacent to the projection 14 and has an engagement recess 18, the engagement projection and recess 14, 18 in combination serving as a first retainer means. More specifically, the engagement recess 18 which is defined between the edge of one of the buckle bodies 10, 12 and the associated bent piece 16 receives the engagement projection 14 formed on the other buckle body, thereby preventing the separation of the buckle bodies 10 and 12 away from each other.

Further, an engagement projection 20 is formed at one side edge of each of the buckle bodies 10 and 12, and a bent piece 22 is formed at the other side edge of the buckle body and is provided with an engagement recess 24. Thus, two sets of corresponding engagement projections and recesses 20 and 24 respectively constitute second and third retainer means. More specifically, the engagement projection 20 formed on the buckle body 10 is received in the engagement recess 24 formed in the buckle body 12 to constitute the second retainer means, while the engagement projection 20 formed on the buckle body 12 is received in the engagement recess 24 formed in the buckle body 10 to constitute the third retainer means. The second and third retainer means are arranged such that the engagement recesses 24 limit the movement of the corresponding engagement projections 20 in the direction of the thickness of the buckle bodies 10 and 12.

Figure 5:
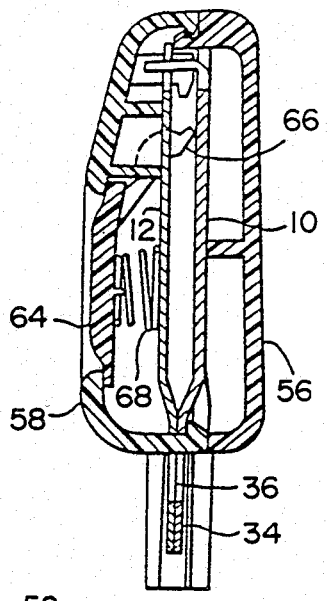
FIG. 5 is a sectional view taken along the line V—V of FIG. 1.
Figure 6:
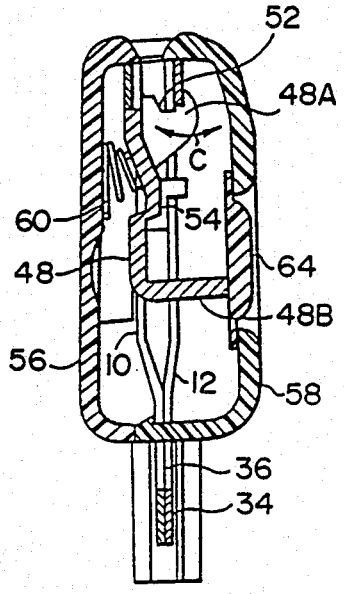
FIG. 6 is a sectional view taken along the line VI—VI of FIG. 1.

In a state wherein the engagement projections 14 are received in the respective engagement recesses 18 and the engagement projections 20 are received in the respective engagement recesses 24, the buckle bodies 10 and 12 are retained while at the same time being separated from each other by a predetermined dimension, as shown in FIGS. 5 and 6. Thus, it is possible for the buckle bodies 10 and 12 to receive tongue plates 26 and 28 in the space defined therebetween. The tongue plates 26 and 28 respectively retain occupant restraining webbings 30 and 32. The other end of each of the webbings 30 and 32 is retained by the body of the child passenger restraining seatbelt system (not shown).

Each of the buckle bodies 10 and 12 is provided at one end portion thereof with an extended piece 34 which is formed by two portions which extend from the end of the buckle body and are bent such that they come toward each other so as to closely contact each other. The extended pieces 34 are respectively formed with slots 36 through which one end of a crotch webbing 38 is retained. The other end of this crotch webbing 38 is retained by the body of the child passenger restraining seatbelt system (not shown). Thus, the crotch webbing 38 is disposed through the crotch of a child passenger.

Each of the buckle bodies 10 and 12 is formed with lock plate receiving bores 40 and 42 in such a manner that the respective axes of these bores extend in the respective directions (the directions of the arrows A and B) in which the tongue plates 26 and 28 are inserted. Lock plates 48 and 50 are pivotally supported along the respective peripheral edges of the lock plate receiving bores 40 and 42.

More specifically, the lock plates 48 and 50 are, as clearly shown in FIG. 3, respectively provided with bent pieces 48A and 50A in pairs, each pair of bent pieces being formed by bending two lateral side portions of the corresponding lock plate at right angles such as to extend in parallel to each other. The bent pieces 48A and 50A are respectively provided with grooves 52. The respective peripheral edges of the lock plate receiving bores 40 and 42 are received in the grooves 52, and the front edges 48C and 50C of the lock plates 48 and 50 abut against the respective peripheral edges of the lock plate receiving bores 40 and 42. Thus, it is possible for the lock plates 48 and 50 to pivot in the direction of the arrow C about the respective peripheral edges of the lock plate receiving bores 40 and 42.

The lock plates 48 and 50 are respectively provided with pawls 54 each of which is formed by cutting and bending a portion of each of the lock plates 48 and 50. The pawls 54 are adapted to engage with engagement openings 26A and 28A which are respectively formed in the tongue plates 26 and 28 which are inserted into the respective spaces defined between the bent pieces 48A and between the bent pieces 50A. When the tongue plates 26 and 28 are in engagement with the lock plates 48 and 50, the lateral movements of the tongue plates 26 and 28 are limited by the bent pieces 48A and 50A. It is therefore possible for the engaged state of the tongue plates 26 and 28 to be reliably maintained even when force acts on the tongue plates 26 and 28 in such a manner that they would be undesirably pried out at the time of a vehicular emergency situation occurring. Accordingly, the structure of the buckle apparatus of the invention is suitable for child passenger restraining seatbelt systems in which the webbings 30 and 32 are apt to be subjected to various kinds of force as well as to a simple pulling force.

The buckle bodies 10 and 12 in their assembled state are covered with lower and upper covers 56, 58 which are connected together in such a manner as to prevent the intrusion of dust into the buckle bodies 10 and 12. As shown in FIG. 6, compression coil springs 60 are respectively interposed between the lower cover 56 and the lock plates 48, 50 in such a manner as to bias the lock plates 48 and 50 in the respective directions in which they are engaged with the inserted tongue plates 26 and 28.

Each of the buckle bodies 10 and 12 has a pair of rectangular bores 62 formed in the vicinity of the engagement projection and recess 14, 18. The bores 62 respectively receive arms 66 which are formed on a pushbutton 64, thereby pivotally supporting the pushbutton 64. A compression coil spring 68 is interposed between the pushbutton 64 and the buckle body 12, whereby the pushbutton 64 is pressed against the upper cover 58 by a relatively large force. An opening 59 is formed in the upper cover 58 for the purpose of allowing a user to press the pushbutton 64. Projections 48B and 50B which project from the respective ends of the lock plates 48 and 50 abut against the pushbutton 64, thus causing the pushbutton 64 to be pressed against the upper cover 58 by means of the biasing force of the compression coil spring 60. Accordingly, the compression coil spring 68 may be omitted. However, provision of the spring 68 favorably makes it necessary for the user to apply a relatively large force when actuating the pushbutton 64, which fact advantageously prevents the lock plates 48 and 50 from being accidentally pulled out of the buckle apparatus when, for example, a child passenger touches the pushbutton 64.

Referring next to FIG. 7, the procedure of assembling the above-described embodiment will be described. First, the buckle bodies 10 and 12 which are placed parallel to each other in side view are pulled apart from each other at one end thereof in such a manner that the angle of intersection at the other end thereof is about 15°, as shown in FIG. 7(B). At the same time, the buckle bodies 10 and 12 are offset from each other in such a manner that the respective center lines P and Q of the buckle bodies 10 and 12 intersect at about 30°, as shown in FIG. 7(A). Under this set of conditions, the buckle bodies 10 and 12 are moved relative to each other in such a manner that the central line Q is coincident with the central line P while the engagement projections 14 are being inserted into the respective engagement recesses 18. Thereupon, the engagement projections 14 are properly received in the respective engagement recesses 18.

Figure 7A:
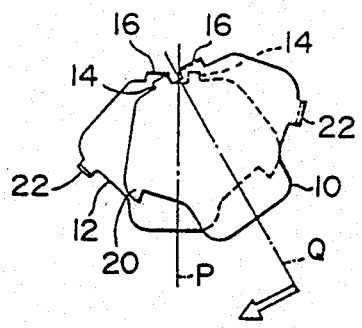
FIG. 7 illustrates the procedure of assembling the embodiment.
Figure 7B:
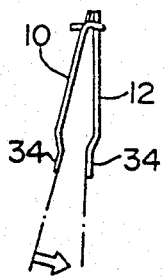
Figure 7C:
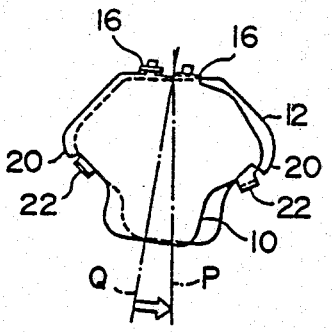
Figure 7D:
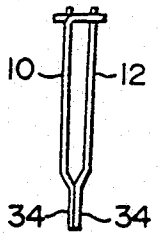
Figure 7E:
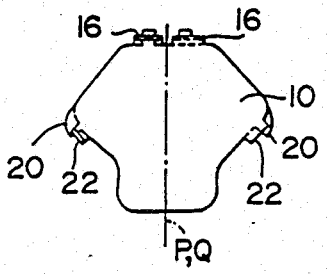
Figure 7F:
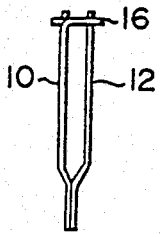

As the buckle body 10 is further moved relative to the buckle body 12 until the central line P passes the central line Q and they cross each other at about 5°, as shown in FIG. 7(C), the engagement projections 20 pass the respective bent pieces 22. At this time, the buckle bodies 10 and 12 are disposed such that their respective planes are parallel to each other and the extended pieces 34 are aligned with each other, as shown in FIG. 7(D). Moreover, the buckle body 10 is returned to its initial position such that the central lines P and Q are aligned with each other, as shown in FIG. 7(E). Thereupon, the engagement projections 20 are received in the respective engagement recesses 24. Thus, the engagement projections 14 and the engagement recesses 18 as well as the engagement projections 20 and the engagement recesses 24 serve as retainer means which limit the dimension of the space defined between the buckle bodies 10 and 12.

The lock plates 48 and 50 respectively have the grooves 52 of the bent pieces 48A and 50A abutting against the respective peripheral edges of the lock plate receiving bores 40 and 42, while the pushbutton 64 has its arms 66 abutting against the respective rectangular bores 62. With the lock plates 48, 50 and the pushbutton 64 placed in this state, the lower and upper covers 56, 58 are mounted thereon, with the compression coil springs 60 and 68 interposed therebetween, and the assembly of the buckle apparatus is thereby completed.

In this embodiment, the buckle bodies 10 and 12 have the same configuration as each other. It is therefore unnecessary to prepare two kinds of buckle body which are different from each other in configuration. Accordingly, the production of the buckle apparatus is advantageously simplified, and the assembly is favorably facilitated.

As the tongue plates 26 and 28 are inserted into the space between the buckle bodies 10 and 12 in the directions of the arrows A and B, respectively, the openings 26A and 28A are respectively engaged with the pawls 54 by means of the biasing forces respectively applied by the compression coil springs 60. Thus, the tongue plates 26 and 28 come in engagement with the buckle apparatus.

Even when a relatively large tension acts on the webbings 30 and 32 at the time of a vehicular emergency, the tongue plates 26 and 28 are reliably supported by the body of the child passenger restraining seatbelt system (not shown) through the lock plates 48, 50, the buckle bodies 10, 12 and the crotch webbing 38.

To cancel the fastening of the webbings 30 and 32, the pushbutton 64 is pressed against the biasing forces respectively applied by the compression coil springs 68 and 60. Thereupon, the pushbutton 64 causes the lock plates 48 and 50 to pivot about the respective peripheral edges of the lock plate receiving bores 40 and 42. In consequence, the pawls 54 are disengaged from the respective engagement openings 26A and 28A, thereby allowing the tongue plates 26 and 28 to be pulled out from the space between the buckle bodies 10 and 12.

It is to be noted that, although the above-described embodiment exemplifies a structure wherein retainer means for limiting the dimension of the space between the buckle bodies 10 and 12 are provided at three positions along the peripheral edge of the buckle bodies 10 and 12, the configuration and structure of the retainer means are not necessarily limited to those described above, and four or more retainer means may be provided.

What is claimed is:

1. A buckle apparatus employed in a vehicle seatbelt system for engaging with a tongue plate attached to the distal end of an occupant restraining webbing when an occupant fastens said webbing around his body, comprising:

(a) a first plate-like buckle body;

(b) a second plate-like buckle body which defines a space for receiving said tongue plate between the same and said first buckle body;

(c) a lock plate supported by at least one of said buckle bodies and engaged with said tongue plate to prevent said tongue plate from being undesirably pulled out of said buckle bodies; and (d) retainer means each constituted by a projection which projects from one of said pair of buckle bodies and a recess formed in the other buckle body, said projection being received in said recess, thereby maintaining the space between said buckle bodies, said retainer means being provided at at least three positions which are spaced from each other, and one of said retainer means being constituted by a bore formed in a bent portion of one of said buckle bodies and a projection which projects from the other buckle body and is received in said bore, wherein said engagement recess and projection are disposed at a portion of each of said buckle bodies such as to be adjacent to each other, the engagement projection of one of said buckle bodies being engaged with the engaged recess of the other buckle body, while the engagement projection of said other buckle body is engaged with the engagement recess of said one buckle body, whereby said buckle bodies are prevented from moving in a direction which would cause them to separate.

2. A buckle apparatus according to claim 1, wherein, when assembled, said pair of buckle bodies are disposed in such a manner that their respective axes are offset from each other, and said buckle bodies are then moved relative to each other until said axes become parallel to each other, whereby said engagement projections are inserted into the respective engagement recesses.

3. A buckle apparatus according to claim 2, wherein another of said at least three retainer means is constituted by a groove-like recess formed in a bent piece constituted by a bent portion of one of said buckle bodies and an engagement projection which is formed on the other buckle body and engaged with said groove-like engagement recess by moving along the surface of said one buckle body.

4. A buckle apparatus according to claim 1, wherein said lock plate has bent pieces respectively constituted by two bent side portions thereof, said bent pieces being respectively formed with grooves which are associated with a lock plate receiving bore formed in the associated buckle body when said lock plate is mounted on said buckle body.

5. A buckle apparatus according to claim 4, wherein there are a plurality of said lock plates which are adapted to be simultaneously actuated by a pushbutton which is mounted on said buckle bodies and is movable in the direction of the thickness of said buckle bodies.

6. A buckle apparatus according to claim 5, wherein said pushbutton has an arm projecting from a portion thereof, said arm being inserted into bores respectively formed in said buckle bodies, thereby allowing said pushbutton to be pivotal about the joint between said arm and said bores.

7. A buckle apparatus according to claim 1, wherein a pair of lock plates are supported by said pair of buckle bodies and are respectively engaged with a pair of tongue plates which are inserted into the space between said buckle bodies in directions which are different for each tongue plate.

8. A buckle apparatus according to claim 1, wherein said pair of buckle bodies have the same configuration as each other, one of said buckle bodies being turned upside down with respect to the other when said buckle bodies are assembled together.

9. A buckle apparatus for use in a seatbelt system designed to protect an occupant of a vehicle in an emergency situation, comprising:

(a) a pair of parallel buckle bodies, wherein said pair of buckle bodies have the same configuration as each other, one of said buckle bodies being turned upside down with respect to the other when said buckle bodies are assembled together;

(b) a plurality of tongue plates inserted into the space defined between said buckle bodies, each of said tongue plates having an occupant fastening webbing retained thereby;

(c) a lock plate mounted on said buckle bodies and engaged with said tongue plates; and (d) at least three retainer means, one of which is constituted by an engagement recess formed in one of said buckle bodies and an engagement projection which is formed on the other buckle body and received in said recess, thereby limiting the separation of said pair of buckle bodies away from each other, wherein said engagement recess and projection are disposed at a portion of each of said buckle bodies such as to be adjacent to each other, the engagement projection of one of said buckle bodies being engaged with the engaged recess of the other buckel body, while the engagement projection of said other buckle body is engaged with the engagement recess of said one buckle body, whereby said buckle bodies are prevented from moving in a direction in which they would separate from each other.

10. A buckle apparatus according to claim 9, wherein, when assembled, said pair of buckle bodies are disposed in such a manner that their respective axes are offset from each other, and said buckle bodies are then moved relative to each other until said axes become parallel to each other, whereby said engagement projections are inserted into the respective engagement recesses.

11. A buckle apparatus according to claim 10, wherein another of said retainer means is constituted by a groove-like enagement recess formed in a bent piece constituted by a bent portion of one of said buckle bodies and an engagement projection which is formed on the other buckle body and engaged with said groove-like engagement recess by moving along the surface of said one buckle body.

12. A buckle apparatus according to claim 9, wherein said lock plate has bent pieces respectively constituted by two bent side portions thereof, said bent pieces being respectively formed with grooves which are associated with a lock plate receiving bore formed in the associated buckle body when said lock plate is mounted on said buckle body.

13. A buckle apparatus according to claim 12, wherein there are a plurality of said lock plates which are adapted to be simultaneously actuated by a pushbutton which is mounted on said buckle bodies and is movable in the direction of the thickness of said buckle bodies.

* * * * *